US010504493B1

(12) United States Patent
Kweon

(10) Patent No.: US 10,504,493 B1
(45) Date of Patent: Dec. 10, 2019

(54) PORTABLE ELECTRIC GUITAR

(71) Applicant: Bum Cheol Kweon, Busan (KR)

(72) Inventor: Bum Cheol Kweon, Busan (KR)

( * ) Notice: Subject to any disclaimer, the term of this patent is extended or adjusted under 35 U.S.C. 154(b) by 0 days.

(21) Appl. No.: 16/374,554

(22) Filed: Apr. 3, 2019

(30) Foreign Application Priority Data

Jun. 12, 2018 (KR) ..... 10-2018-0067546

(51) Int. Cl.
*G10D 1/08* (2006.01)
*G10D 3/06* (2006.01)

(52) U.S. Cl.
CPC ..... *G10D 1/085* (2013.01); *G10D 3/06* (2013.01)

(58) Field of Classification Search
CPC ..... G10D 1/085; G10D 3/06
See application file for complete search history.

(56) References Cited

U.S. PATENT DOCUMENTS

2009/0084243 A1* 4/2009 Pyper-Scott ..... G10D 1/08 84/293

FOREIGN PATENT DOCUMENTS

| | | | |
|---|---|---|---|
| KR | 10-2008-0082750 | A | 9/2008 |
| KR | 10-2010-0107881 | A | 10/2010 |
| KR | 10-2011-0072603 | A | 6/2011 |

* cited by examiner

*Primary Examiner* — Kimberly R Lockett
(74) *Attorney, Agent, or Firm* — Goldilocks Zone IP Law

(57) ABSTRACT

A portable guitar may include a neck provided with a string on its top surface, a head machine provided on one side of the neck and provided with a piezo device for amplifying a sound, a first and a second covers hinged on both sides of the neck by hinges and configured to open or close the neck by rotating about the hinges, a speaker installed in the inner space of the first cover, a detecting sensor installed on the first cover and configured to detect the closing or opening of the first cover and output a signal, and a controller for controlling for supplying a power to the piezo device and selectively switching a mode of the speaker into an amplifier mode or a speaker mode based upon the detected signal.

3 Claims, 5 Drawing Sheets

PORTABLE ELECTRIC GUITAR

CROSS-REFERENCE TO RELATED APPLICATIONS

This application claims priority under 35 U.S.C. § 119 to Korean Patent Application No. 10-2018-0067546 filed on Jun. 12, 2018 in the Korean Intellectual Property Office, the disclosure of which is incorporated herein by reference in its entirety.

TECHNICAL FIELD

The present invention relates to a portable electric guitar, and more particularly, it is possible to output a guitar sound in a state amplified through a speaker even when a guitar sound is played only by a neck without a body. In addition, aspect of the present invention relates to a portable electric guitar which can be easily and at anytime and anywhere, and can be used as a general speaker.

BACKGROUND OF THE INVENTION

Generally, guitar is a kind of stringed instrument, which produces a sound while bending the string. It can be applied to various genres of music compared to other instruments.

In addition, the guitar is relatively easy to perform compared to other string instruments such as cello, violin, etc., and can express various ranges and rhythms. It is widely known and easily accessible because of its various shapes, tones, and functions. Thus, the guitar is relatively widespread.

The electric guitar, which is one of type of guitar, generally includes a body having a built-in acoustic amplifying device, a neck coupled to the body, a head coupled to the neck, and a string connected to the head and a bridge mounted on the body. In addition, a pickup, which serves to convert the vibration of the string into an electric signal, is mounted on the front portion of the body.

On the other hand, the electric guitar is a system in which the body and the neck are directly connected, and the assembly is already completed at the time of factory shipment and is not separated except for special situations such as repair or maintenance. Therefore, it is a disadvantage of purchasing a new guitar if it becomes tired of the body form and the like since it is used until the guitar is broken after releasing from the factory.

Moreover, it is more important for a beginner to learn guitar playing by understanding the code and scales through constant practice.

There are many constraints to practicing while carrying because the conventional electric guitar including both the body and the neck is bulky and difficult to carry.

CITED ARTS

Patent Document

Patent Document 1: Published Patent Publication No. KR 10-2008-0082750, Title of Invention: Electric guitar for separation and Assembly, Publication Date: Sep. 12, 2008.

SUMMARY OF THE INVENTION

Problems to be Solved

Accordingly, it is an object of the present invention to provide a portable electric guitar capable of generating guitar sound without a body.

According to another aspect of the present invention, there is provided a portable electric guitar for use with a speaker, which is normally used as a speaker, and a neck is exposed to the outside according to an opening operation of a first and a second covers to play an electric guitar.

Means for Solving the Problems

According to an aspect of the present invention, there is provided a portable electric guitar including: a neck provided with a guitar string on an upper surface the neck; a head provided on one side of the neck and provided with a piezo device for amplifying a sound; a first cover and a second cover, which is coupled to the each side of the neck and covers the outer surface of the neck and rotatably opens and closes the neck by rotating around a first and second hinges, respectively, thereby causing to expose the neck to an outside; a detecting sensor which is provided on the first cover and outputs a signal according to a rotation opening and a rotation closing operation of the first cover, and a controller, which supplies or blocks power to a piezo device in accordance with a detected signal outputted from the detecting sensor, and controls for selectively switching the speaker into an amplifier mode or a general speaker mode.

Effective of the Invention

The present invention can output a guitar sound by amplifying through a speaker even if the guitar is played only by the neck without the body, thereby reducing the volume of the electric guitar so that it is easy to carry and playing the guitar at any place without limitation of playing. In addition, it is possible to use the electric guitar as a general speaker in a normal time, thereby improving practicality.

DETAILED DESCRIPTION OF THE INVENTION

Hereinafter, embodiments of the present invention will be described with reference to the accompanying drawings. In the following detailed description, exemplary embodiments of the present invention will be described in order to accomplish the above-mentioned technical problems. And other embodiments which may be presented by the present invention are replaced by descriptions in the constitution of the present invention.

In the meantime, it is possible to play music only on the neck without the body, which is representative of the electric guitar. However, it is obvious that the present invention can be applied to all string instruments such as a Violin, a Ukulele, and a Mandolele according to an aspect of the present invention.

Figure 1:
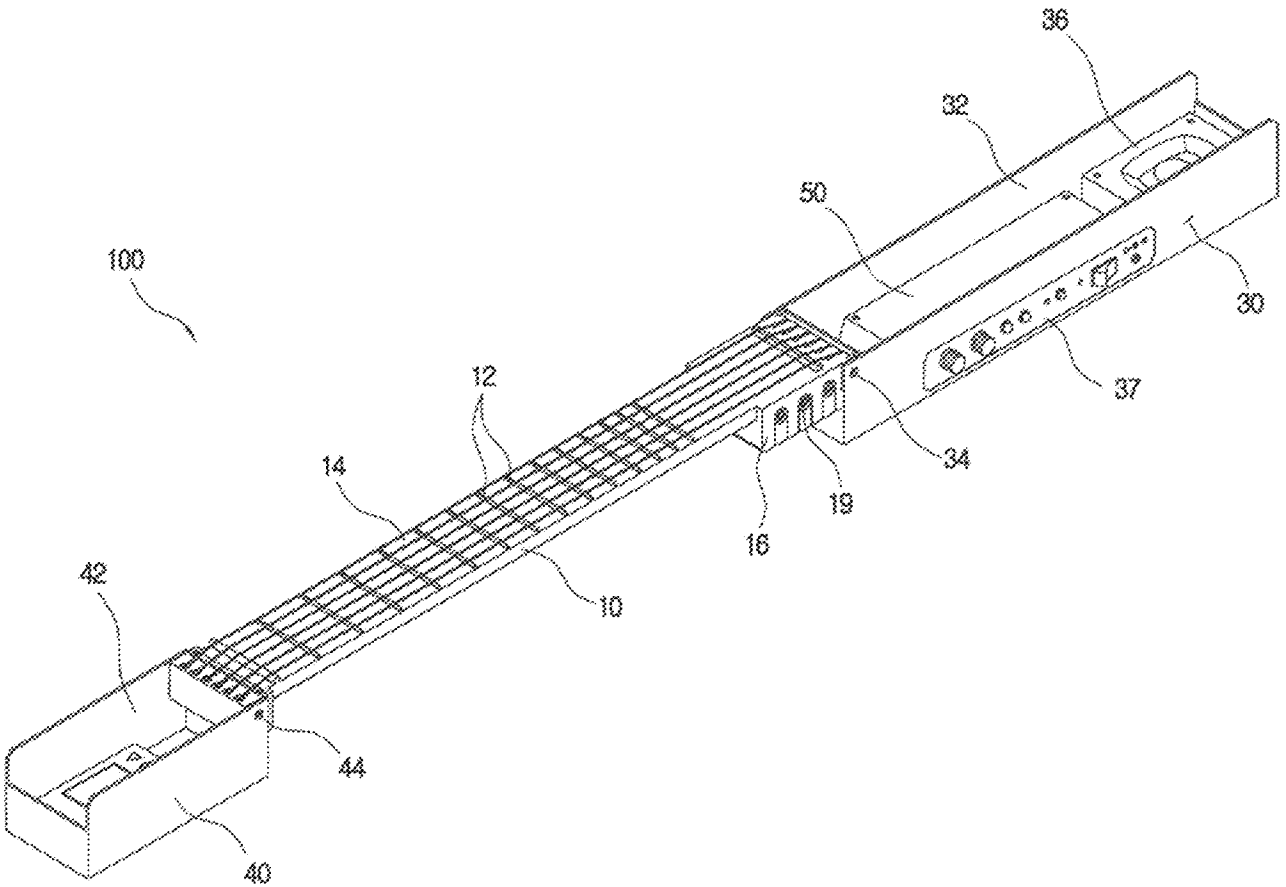
FIG. 1 is a diagram showing the overall configuration of a portable electric guitar according to an embodiment of the present invention.
Figure 2:
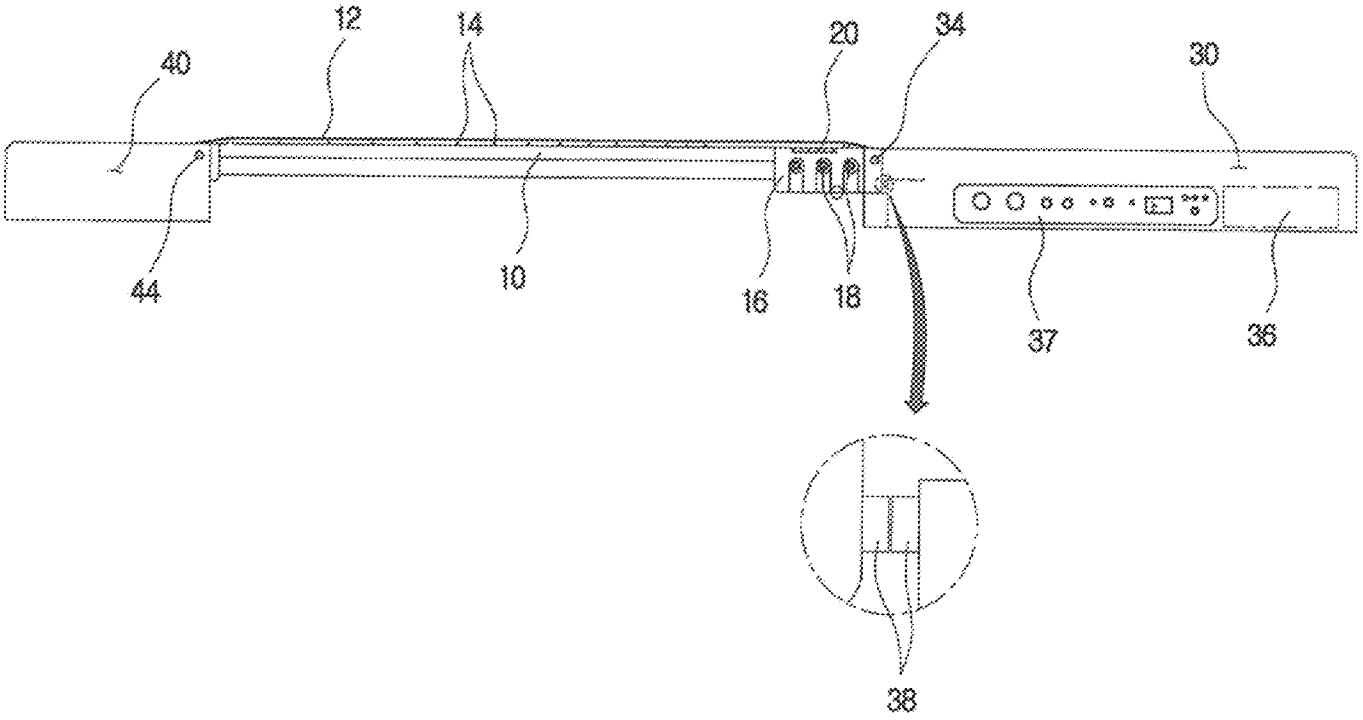
FIG. 2 is a view showing a state in which the first and second covers are opened in FIG. 1.
Figure 3:
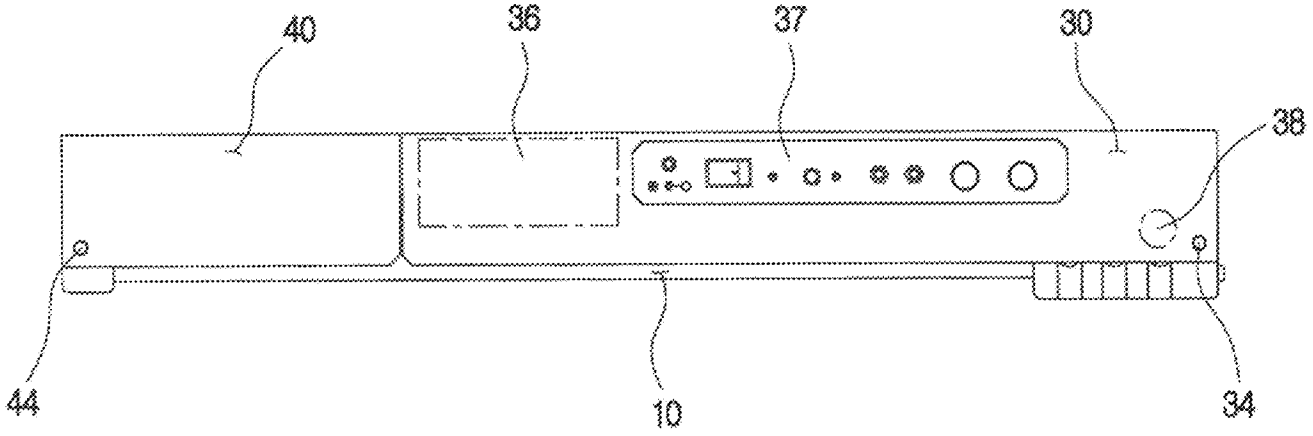
FIG. 3 is a view showing a state in which the first and the second covers of FIG. 1 are closed.
Figure 4:
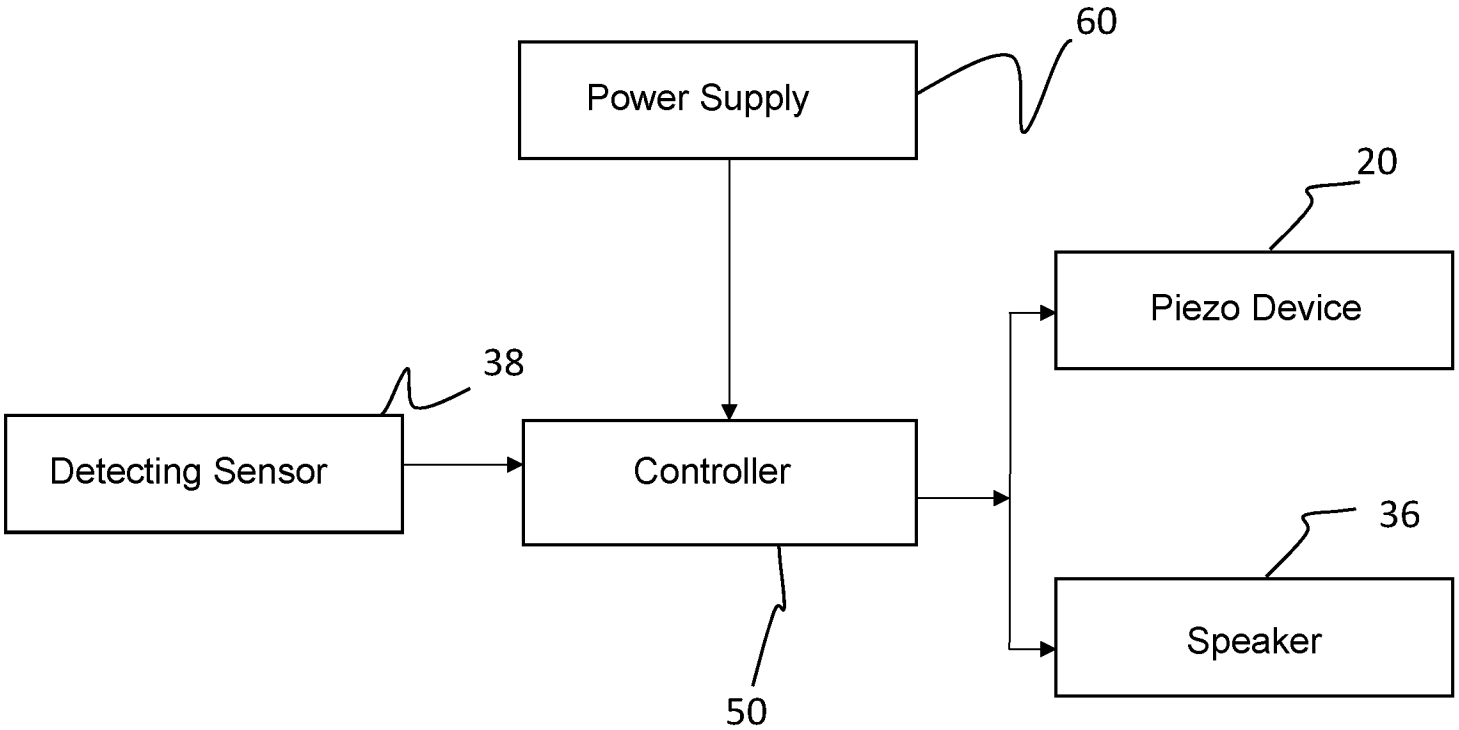
FIG. 4 is a block diagram of the detecting sensor and the controller of FIG. 1.

FIG. 1 is a view showing a portable electric guitar according to an embodiment of the present invention, FIG. 2 is a view showing a state in which the first and the second covers are opened in FIG. 1, FIG. 3 is a view showing a state in which the first and the second covers are closed, and FIG. 4 is a block diagram of the detecting sensor and the controller of FIG. 1.

As shown in FIGS. 1 to 4, the portable electric guitar may include only a neck 10 without using a body unlikely a conventional guitar, and the outer surface of the neck 10 is enclosed by the first and second covers 30, 40 according to an aspect of the present invention.

A portable electric guitar may include a neck 10, at least one fret 12 is provided on an upper surface of the neck 10, and a first and a second covers 30, 40 are provided on one side and the other side of the neck 12, respectively, and connected to the neck by a first and a second hinge connectors 34, 44, respectively.

Guitar strings 14 are provided on the fret 12, which is provided on the upper surface of the neck 10. The guitar strings 14 are arranged in lines such that the number of the guitar strings 14 is 6 strings, which is the same the numbers of conventional guitar strings a conventional guitar.

A head machine 16, is installed at one side of the neck 10. A tuning gear 18 is installed in the head machine 16. Guitar strings 14 are wounded on the tuning gear 18, which are provided on the upper surface of the neck 10. The guitar strings 14 are pulled tightly to adjust the sound by rotating the tuning gear 18.

Please be noted that a head, a head machine, or head means are the same device.

The head machine 16 is further provided with a piezo device 20. The piezo device 20 is a device provided to amplify a sound when a guitar is played with the electric guitar manufactured without a body according to an aspect of the present invention.

The electric guitar having such a structure can be formed only of the neck 10 without the body, thereby minimizing the volume of the guitar. As a result, the volume of the electric guitar can be reduced as a result, a guitar performance can be performed at anywhere without limitation.

Meanwhile, the electric guitar 100 may perform functions of a speaker mode and an amplifier mode in accordance with opening and closing operations of the first and second covers 30, 40 according to an aspect of the present invention.

Preferably, the electric guitar 100 may have a speaker function when the neck 10 is closed by covering by the first and the second covers 30, 40 and may have a function of playing the guitar by using the guitar strings 14 provided on the neck 10 when the first and the second covers 30, 40 are opened to expose the neck 10 to an outside according to aspects of the present invention.

Herein, the speaker mode refers to a mode for allowing the user to hear music supplied from various external audio equipment, and the amplifier mode refers to a mode for outputting sound while amplifying guitar sounds when playing the guitar. The control operation is performed by a speaker according to a control signal of the controller 50.

The first cover 30 is configured to have an "∩" cross-sectional shape and a first space 32 capable of accommodating the neck 10 therein and is formed in the opened state at the lower end. The first cover 30 covers one side of the upper surface of the neck 10 so that one end of the first cover 30 is coupled to a first hinge connector 34 by a hinged connecting, thereby the neck 10 is exposed to the outside by rotating the first cover 30 about the first hinge connector 34.

A speaker 36 is installed in the first space 32 of the first cover 30 and an operation part 37 for controlling a sound intensity of the speaker 36 is provided on the outer surface of the first cover 30.

A detecting sensor 38 is comprised of a first part and a second part, and the first part may be provided one side of the first cover 30 and the second part may be provided on one side of the head machine 16. When the opening operation of the first cover 30 is completed, the detecting sensor 38 detects the opening operation by contacting the first part of the detecting sensor 38 and the second part of the detecting sensor 38 each other and outputs a signal to the controller 50. However, it is not limited thereto, the detecting sensor, can be a contact switch, but have any kind of switch can be installed as long as detecting the operation of the first cover whether the neck is covered. The controller 50 may receive a signal from the detecting sensor 38 and output a signal to switch a mode of the speaker 36 to perform an amplifier function when playing the guitar.

At this time, the controller 50 may switch a mode of the speaker 36 into the amplifier mode according to the signal of the detecting sensor 38, and switch the piezoelectric device 20 for performing the tone transfer function installed in the head machine 16 described above.

In addition, at the same time as the closing operation of the first cover 30 is progressed, the detecting sensor 38 detects the closing operation of the cover 30 by releasing the contacting between the one side of the detecting sensor and the other side of the detecting sensor 38. At the same time, a signal is outputted to the controller 50 so that the controller 50 switches a mode of the speaker 36 into a general speaker mode and turns the piezoelectric device 20 off. Preferably, the mode of the speaker 36 switched into the general speaker mode may adopt the Bluetooth, which is a near-field wireless technology for receiving music by being connected with a smart phone, MP3, and/or radio.

The second cover 40 is configured to have a "fl" cross-sectional shape and a second space 42 in which the neck 10 can be received is formed in a state where the lower end is opened. The second cover 40 covers the upper surface of the other side of the neck 10 and connects to the neck by the second hinge connector 44 provided on the other side of the neck 10, and the neck 10 is exposed to the outside by rotating the second cover 40 about the second hinge connector 44.

Figure 5:
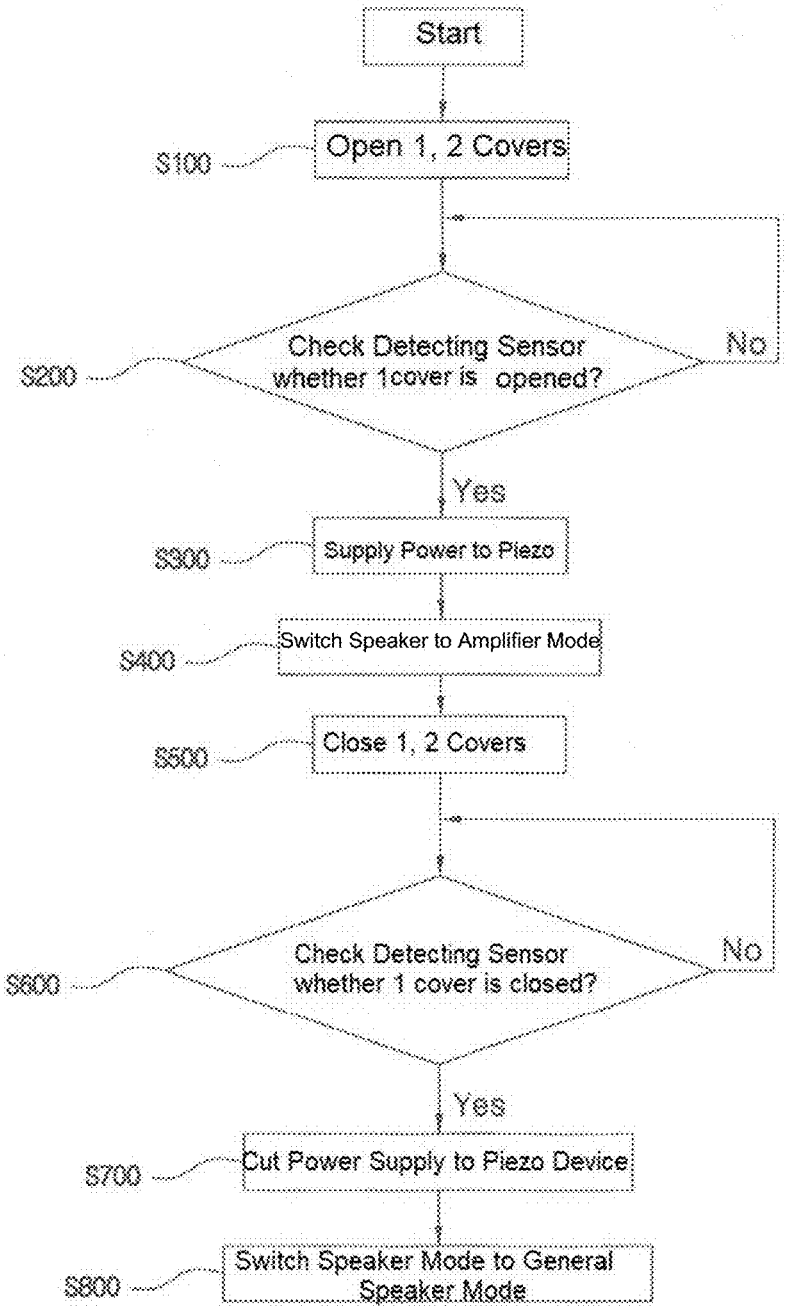
FIG. 5 is a flow chart illustrating an operational flow for switching a mode of a portable electric guitar from an amplifier mode to a speaker mode according to an embodiment of the present invention.

Hereinafter, the operation of the portable electric guitar will be described with reference to FIG. 5 according to an aspect of the present invention.

First, when playing a guitar with a portable electric guitar, the first and the second covers 30, 40 are opened for exposing the neck 10 to the outside S100 according to an aspect of the present invention. At this time, the opening operation of the first and the second covers 30 and 40 means that the first and the second covers 30 and 40 are rotated about the hinge connectors 34, 44 in an outward direction, respectively.

After the opening of the first cover 30 is completed by rotating about the first hinge 34, the detecting sensor 38, provided on between one side of the first cover 30 and the head machine 16, can output a signal to the controller 50. The detecting sensor 38 may detect whether the first cover is covered. However, it is understood that any type of a detecting sensor can be used as long as detecting the status of the first cover is closed or opened. The controller 50 supplies a power from a power supply 60 to the piezo device

20 according to a detection signal of the detecting sensor 38 S300 and a mode of speaker 36 is switched into an amplifier mode by the controller 50 S400.

That is, when the guitar is played with a portable electric guitar according to the opening operation of the first and the second covers 30, 40, the guitar sounds are outputted in a state in which the sound is amplified by the piezo device 20 and the speaker 36, a guitar player can play guitar like an electric guitar.

At this time, once the first and second covers 30, 40 are completely opened, the length of the first and second covers 30, 40 is added to the length of the neck 10, it is similar to the length of a conventional electric guitar, so you can avoid the inconvenience of playing.

On the other hand, when the guitar is played, the first and the second covers 30, 40 in which the opening operation is completed by rotating about the hinge connectors 34, 44, and covers the outer surface of the neck to perform closing operation S500.

At this time, after the closing operation of the first cover 30 is completed, the detecting sensor 38 senses closing of the first cover 30 and outputs a sensing signal to the controller 50. And then, the power supplied to the piezo device 20 is cut off by the controller 50 according to the detecting signal S700, and a mode of the speaker 36 is switched into a general speaker mode which produces sound in an amplifier mode S800.

That is, the portable electric guitar which has completed the closing operation of the first and the second covers 30 and 40 can be used to listen to a sound source input from the outside through a speaker, which is switched into a general speaker mode, for example, a smart phone, and MP3.

Thus, it is possible to enjoy music by being connected with a device that can be played.

While the invention has been shown and described with reference to certain exemplary embodiments thereof, it will be understood by those skilled in the art that various changes in form and details may be made therein without departing from the spirit and scope of the invention as defined by the appended claims and their equivalents.

DESCRIPTION OF REFERENCE NUMERALS

10: neck
14: guitar strings
16: head machine
20: piezo device
30: first cover
32: a first space
34: first hinge connector
36: speaker
38: detecting sensor
40: second cover
42: second space
44: second hinge connector
50: controller
60: Power Supply

What is claimed is:

1. A portable electric guitar, comprising:

a neck provided with a guitar strings on an upper side of the neck;

a head machine is provided on one side of the neck;

a piezo device is provided on the head machine for amplifying a sound;

a first cover configured to have a "∩" cross-sectional shape and connected to one end of the neck by a first hinge and to have a first space capable of accommodating the neck therein when the first cover is in a opened state at a lower end and by rotationally opening or closing the neck to the outside about the first hinge;

a second cover configured to have a "∩" cross-sectional shape and connected to one other end of the neck by a second hinge and to have a second space capable of accommodating the neck therein when the second cover is in a opened state at a lower end and rotationally open or close the neck to the outside by rotating about the second hinge;

a speaker accommodated in the first space of the first cover;

a detecting sensor configured to sense closing or opening of the first cover and output a signal to a controller according to the closing or the opening of the first cover; and the controller configured to receive the signal from the detecting sensor, to switch a mode of the speaker between a speaker mode and an amplifier mode, and to turn the piezo device on or off for playing the guitar.

2. The portable electric guitar according to claim 1, wherein the detecting sensor is composed of a first part and a second part, outputs the signal when the first part and second part is contacted or not according to closing or opening operation of the first cover, wherein the first part of the detecting sensor is attached to the first cover and the second part of the detecting sensor is attached to the head machine, wherein the first part and the second part of the detecting sensor are contacting each other if the first cover is opened.

3. The portable electric guitar according to claim 1, wherein the controller outputs a control signal to switch a mode of the speaker to amplifier mode on the piezo device for playing the electric guitar when the neck is exposed to outside by opening of the first cover and the second cover, and the controller outputs the control signal to switch a mode of the speaker to a general speaker mode from the amplifier mode if the neck is closed by the first and the second covers.

* * * * *